US005455969A

United States Patent [19]

Pratson et al.

[11] Patent Number: 5,455,969

[45] Date of Patent: Oct. 10, 1995

[54] MULTI-PURPOSE IMPROVED HINGED KNEE PROTECTOR

[75] Inventors: David C. Pratson, Oceanside; Charles B. Knox, Del Mar, both of Calif.

[73] Assignee: Knee-Pro Industries, Inc., Vista, Calif.

[21] Appl. No.: 185,131

[22] Filed: Jan. 24, 1994

[51] Int. Cl.[6] ..... A41D 13/00

[52] U.S. Cl. ..... 2/24

[58] Field of Search ..... 2/16, 22, 23, 24, 2/62, 452, 421, 446; 24/301, 302, 196, 200, 297, 312, 306, 265 BC; 602/16, 23, 26; 403/353

[56] References Cited

U.S. PATENT DOCUMENTS

| | | | |
|---|---|---|---|
| 2,031,622 | 2/1936 | Walker | 2/24 |
| 4,633,529 | 1/1987 | Litz | 2/24 X |
| 4,751,748 | 6/1988 | Ekins | 2/24 X |
| 4,884,561 | 12/1989 | Letson, Sr. | 2/24 X |
| 5,031,240 | 7/1991 | Nierhaus | 2/24 |

FOREIGN PATENT DOCUMENTS

| | | | |
|---|---|---|---|
| 2513002 | 10/1976 | Germany | 2/24 |

OTHER PUBLICATIONS

Knee–Pro Brochure by KP Industries, (Brochure Describing the Product Was Sold Before, Jan., 1993).

*Primary Examiner*—Clifford D. Crowder
*Assistant Examiner*—Paul C. Lewis
*Attorney, Agent, or Firm*—Henri J. A. Charmasson; John D. Buchaca

[57] ABSTRACT

An apparatus for protecting a user's knee or other joint which comprises two generally semi-cylindrical rigid members each having semi-hemispherical overlapping portions and hingedly connected to allow a movement of the joint. Additional features of the protector include a replaceable inner pad, easily releasable and reusable hinges which provide the only attachment means for inner padding of the protector, replaceable outer attachment strips which may be made of varying materials which provide different adhesion properties, slightly elastic straps, and an attachment clip which adjustably attaches to one end of a strap and securely and releaseably attaches to a buckle located on a side edge of the rigid semi-cylindrical member.

20 Claims, 2 Drawing Sheets

9
60
67
65
63
69
68
61
66
70
71
64
62

20
88
97
98
99
101
103
87
93
102
100

60
72
62
9
68

82
83
89
96
85
26
80
81
95
86
94
84

26
81
83
86
80
82
89
85

103
102
97
99
87
101
93
100

80
81
82
96
92
89
86
20

92
91
96
20

93
97
103
90
87
88
102

MULTI-PURPOSE IMPROVED HINGED KNEE PROTECTOR

FIELD OF THE INVENTION

This invention relates to protective body coverings and more specifically to joint guards and particularly to knee protectors.

BACKGROUND OF THE INVENTION

Many activities, both recreational and work related entail placing certain joints of the body into contact with surfaces which over time tend to lead to discomfort and even injury. People who work on their knees such as carpet layers, roofers, welders, mechanics and agricultural workers, to name a few, benefit from knee protection.

Currently, the only inexpensive generic knee protection available to the consumer consists of various forms of knee pads. FIG. 1 shows a typical knee pad which comprises a block 1 of resilient compressible material which is attached to a fabric sheet 2 which in turn is held in place over the front of the knee by straps 3,4 wrapping around the back of the knee. To fit different sized knees, the straps are usually adjustable by being elastic, using a buckle or using other means.

Although this type of knee protector is inexpensive, it suffers from a lack of functionality in four key areas. First, it is not held in place on the front of the knee as securely as is sometimes desired. Lateral forces can easily move the protector off center or it can work itself off of the kneecap through repeated movement. The usual solution to this problem would be increasing the strength or coverage of the straps. However this solution tends to reduce flexibility and comfort over extended periods of time.

Second, it does not have a hard rigid outer casing to protect the knee from sharp objects or surfaces and from scuffing. Those that have been designed with hard outer plates 5 as shown in FIG. 2, have increased trouble maintaining their position over a kneecap and provide protection only to a limited portion of the front of the knee. The coverage changes depending on whether the user's knee is straight or bent. This plate further tends to restrict the movement of the user's knee.

Third, these products suffer from not providing the proper adhesion when working on different types of surfaces. Those devices that do provide adequate adhesion on one surface such as roofing tiles do not allow the sliding required by carpet layers. Also, devices designed for one surface may suffer from wearing out too quickly when used on another surface.

Finally, most of these devices employ means for attaching which are relatively inconvenient or uncomfortable. Those devices which use single length elastic straps can, over time, become quite irritating to the user if they are too tight or too loose. Those devices with adjustable attachment straps either require too much time to attach and take off, or cannot be set to a predetermined size by the user, requiring tightening or loosening each time the user uses the product.

It would therefore be desirable to have an inexpensive product for protecting a user's knee or other exposed joint with a protector that remains situated over the user's joint comfortably and more securely than current designs, allows total freedom of movement while maintaining full coverage protection, allows quick and simple attachment and detachment in a consistent manner, provides for simple and easy repair and replacement of its components such as the padding, and provides proper adhesion to a variety of surfaces for a wide variety of applications.

SUMMARY OF THE INVENTION

The principal and secondary objects of this invention are to provide an inexpensive apparatus which more comfortably, conveniently and effectively protects a user's knee or other joint during a wide if not full range of movement. Further objects of the invention are to provide:

- Protective coverage which will not lessen when the knee is bent;
- Means for attaching the protector to the knee which shall be easy, quick and consistent, not requiring repeated adjustment;
- Components of the device being reusable, easily replaceable when worn-out and interchangeable depending on the user's application;
- Proper adhesion on multiple surfaces; and,
- Means which extend the useful lifetime of the apparatus.

These and other objects are achieved by two semi-cylindrical rigid members hingedly connected to form a protector which allows thigh and calf attachment means while allowing full range of movement with the knee. The portion of the two semi-cylinders which contact each other are uniquely formed to allow continuous coverage of the knee whether it is straight or bent. Additional features of the protector include easily releasable and reusable hinges which provide the only attachment means for inner padding of the protector, replaceable outer adhesion strips which may be made of varying materials which provide different adhesion properties, slightly elastic straps, and an attachment clip which adjustably attaches to one end of a strap and securely and releaseably attaches to a buckle located on a side edge of the rigid semi-cylindrical member.

DESCRIPTION OF THE PREFERRED EMBODIMENT OF THE INVENTION

Figure 1:
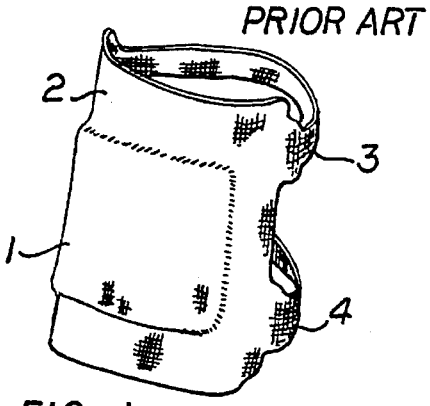
FIG. 1 is a perspective drawing of a typical knee pad-style protector having dual elastic straps typical in the prior art.
Figure 2:
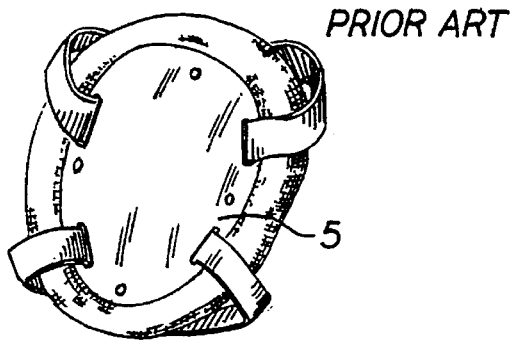
FIG. 2 is a perspective drawing of a prior art dual elastic strapped knee protector having a rigid and slick outer covering typical of those used to install carpet.
Figure 3:
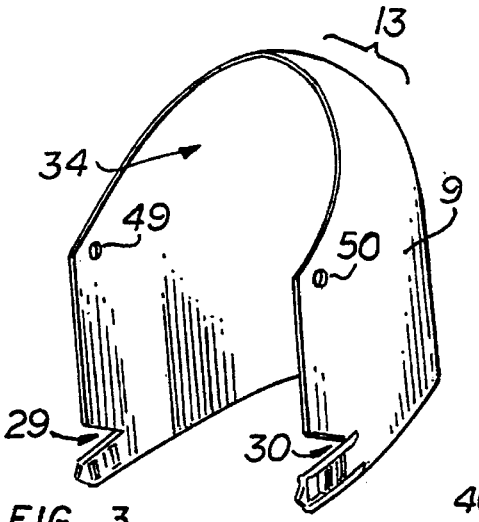
FIG. 3 is a perspective view of the lower semi-cylindrical member.
Figure 4:
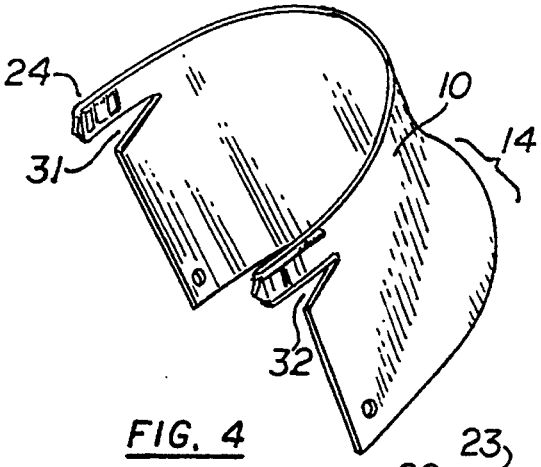
FIG. 4 is a perspective view of the upper semi-cylindrical member.
Figure 5:
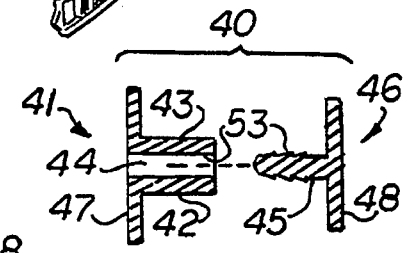
FIG. 5 is a cross-sectional view of a releasable and reusable rivet which forms a pivot point for the invention.
Figure 6:
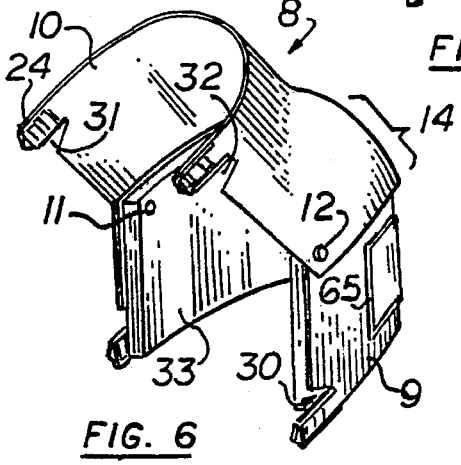
FIG. 6 is a perspective drawing of a hinged knee protector described by the invention.
Figure 7:
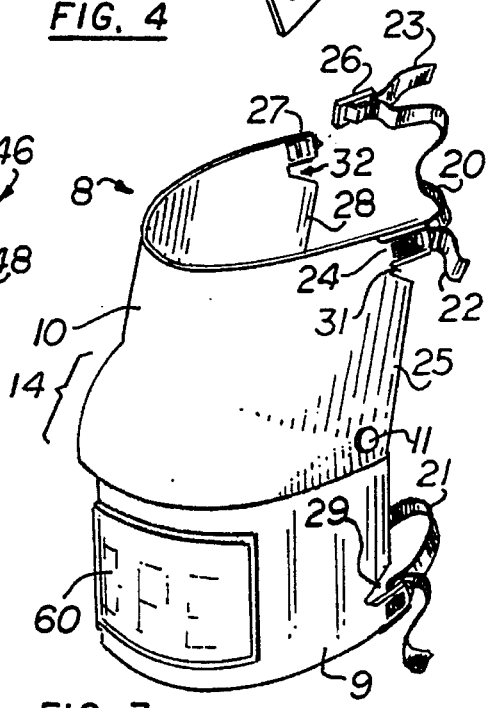
FIG. 7 is a perspective drawing of a rearview of the apparatus shown in FIG. 6.

Referring now to the drawing, FIGS. 3 through 7 show a knee protector 8 comprising a lower semi-cylindrical member 9, an upper semi-cylindrical member 10, which are pivotably connected together at two pivot points 11,12 which allow a hinged mobility between the members. The lower member 9 has an upper end portion 13 which is shaped like a wedge section of a hemisphere, a semi-hemisphere for lack of a better word. The upper semi-cylindrical member 10 has a lower end portion 14 with a similar section of a hemisphere. However, the dimensions of the portion of the upper member are slightly larger than the portion on the lower member to allow the lower member to slidingly overlap within the upper member when the two members are connected at the pivot points. It must be understood that the function of the upper and lower semi-cylindrical members may be interchanged so that upper member travels within the lower without departing from the spirit of the invention. The operative feature of one member moving within another provides an increase in the rigid, outward facing protective surface when the user bends his or her knee.

The protector further includes a means for attaching the protector to a user's knee in the form of a pair of adjustable straps 20,21. The top strap has two ends 22,23. A first end is releaseably attached to the protector at a first connection point 24 located on a side edge 25 of the protector. The other end is adjustably attached to a clip 26. The clip in turn provides means for releaseably attaching itself to a second connection point 27 located on the other side 28 of the protector. The lower strap 21 has similar connections.

The means for attaching the strap to the first connection point may be relatively permanent such as a rivet but is preferably adjustable and releasable to allow for easy replacement of the strap. In the preferred embodiment, both connection points for a given strap will be buckle style connectors designed to provide attachment for a strap or a clip. Most of the features described in this specification should be substantially symmetric or otherwise designed to allow for use on either knee by both left or right-handed users, further reducing the costs of manufacture.

Cuts 29,30,31 and 32 adjacent to the connection points reduce the rigidity of the lateral position of the connection points. This allows the connection points to bend inward slightly depending on the size of the user's leg and the tightness of the straps. This in turn provides for a more snug and hence, comfortable fit to a user's thigh or calf.

The protector further comprises a pad 33 mounted to an inner surface 34 of the lower semi-cylindrical member. The pad is made from compressible, resilient material such as foam rubber and is formed to comfortably engage a user's knee. The pad is held in place by a pair of releasable and reusable rivets 40, each of which form the pivot points for the protector. Each rivet is made up of an inner piece 41 having a main body 42 with a cylindrical outer surface 43 and a central bore 44 which is sized to engage the prong 45 of an outer piece 46. Both pieces have disk-shaped end flanges 47,48 which prevent further penetration of the rivet through holes 49,50, 51 and 52 positioned on both upper and lower semi-circular members and the inserted pad. Both the bore and prong have concentric nibs 53 which inhibit extraction of the prong.

Figures 8, 9, 10, 11, 12, 13, 14, 15, 16, 17:
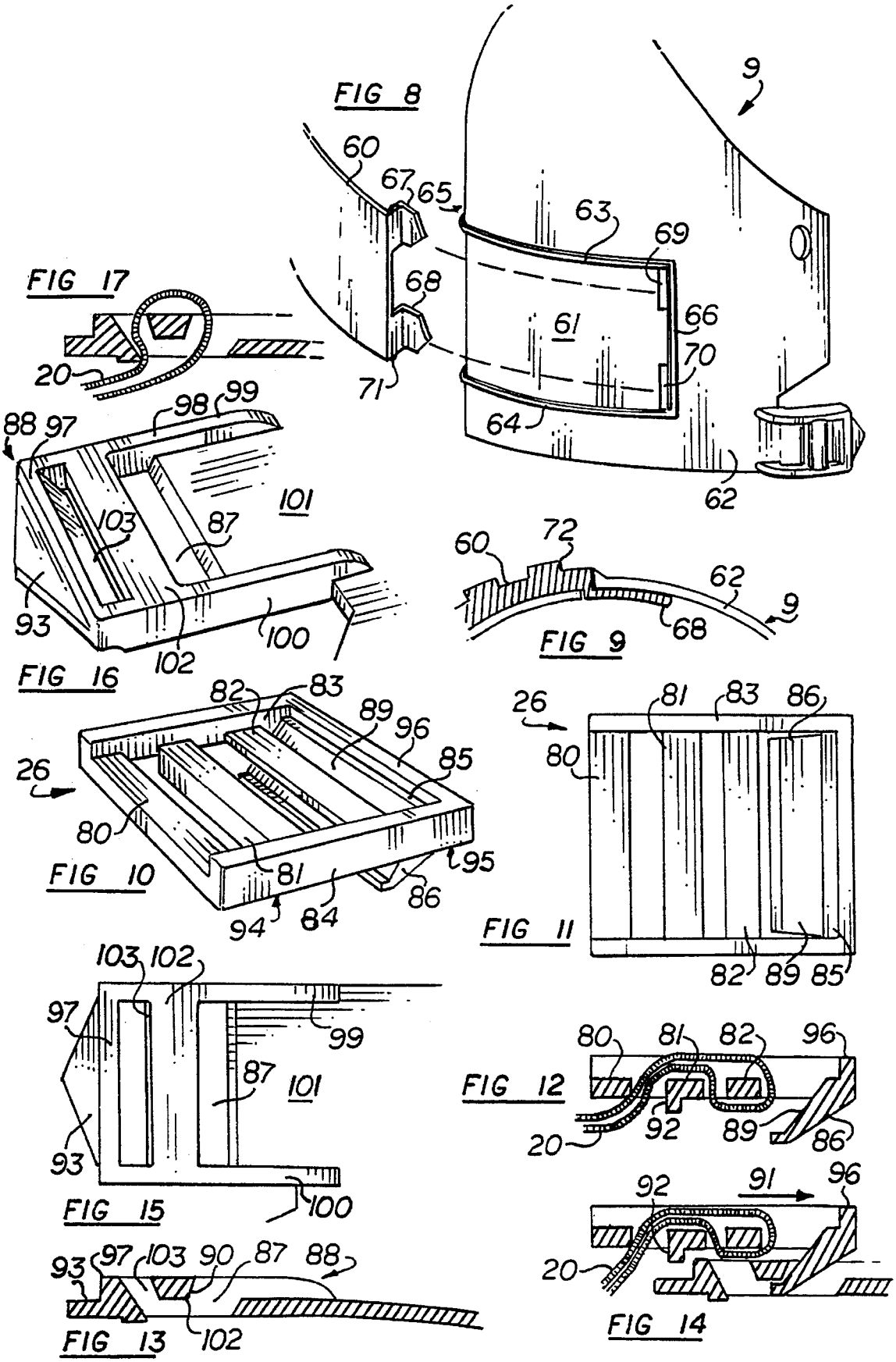
FIG. 8 is a perspective drawing of the lower semi-cylindrical member showing the releasable adhesion strip in a detached position.
FIG. 9 is a cross-sectional view of an adhesion strip engaged in the lower semi-cylindrical member.
FIG. 10 is a perspective view of the preferred embodiment of the clip described by the invention.
FIG. 11 is a top view of the clip from FIG. 10.
FIG. 12 is a cross-sectional view of the clip with a strap interwoven therein.
FIG. 13 is a cross-sectional view of one side of a semi-cylindrical member showing a connection point or buckle.
FIG. 14 is a cross-sectional view of the clip interlocking the connection point or buckle.
FIG. 15 is a top view of a connection point buckle.
FIG. 16 is a perspective view of a connection point buckle.
FIG. 17 is a cross-sectional view of a buckle connection point with a strap adjustably threaded through it.

The protector also includes a replaceable outer adhesion and protection strip 60. FIG. 8 and 9 show the lower semi-cylindrical member 9 with a curved frame portion 61 integral with the outer surface 62 of the member. The frame is made up of a bordering ridge which provides stability to the attached strip. In this embodiment, the frame comprises a top ridge 63, a bottom ridge 64 and a two side ridges 65 (not shown) and 66. The strip 60 has a pair of resilient projections 67,68 spaced apart from one another. Each projection is sized and dimensioned to engage an aperture extending through the member from its outer surface to its inner surface. In this embodiment a pair of oblong apertures 69,70 are positioned adjacent to each side ridge within the frame. Once engaged, each projection has a nib 71 which inhibits extraction of the projection from the aperture. The strip thereby is securely positioned on the member where most of the wear will occur. It provides a protective surface which will bear the wear and display the proper static and dynamic friction properties for the user's current application.

The frame need not have what appears to be a rectangular shape. It may be any shape including any number of curved or straight ridges.

For most purposes, a strip made of thermal plastic rubber or similar material will provide rugged protection and proper adhesion to both slick and coarse surfaces. A strip with a slippery plastic coating may be more useful for carpet installing applications. For applications involving fluid covered surfaces, such as automotive repair in oily garages, the strip may have raised tread or knobs 72 which provide added friction. The raised tread or knobs may be in the form of lettering to communicate all types of messages. Backward lettering may be used by landscapers to imprint their business name into the dirt where they work. By making the strip replaceable, the useful lifetime of the protector is greatly extended.

Although, as previously described, the straps may be attached to the semi-cylindrical members themselves by exclusively using the buckle type connectors, using a clip greatly increases comfort and efficiency. FIGS. 10 through 16 show that a strap 20 may be adjustably attached to a separate clip 26 which retains the user's adjustment even after the protector is removed from the knee. The strap is looped around a group of three substantially parallel cross-pieces 80,81 and 82, which are held in place by two oblong side-pieces 83 and 84. A fourth cross-piece 85 provides a hook 86 which extends below the plane of the other cross-pieces in this orientation. The hook is sized and dimensioned to releaseably engage a slot 87 in a buckle connector 88.

The buckle itself is made up of two substantially parallel side-members 99 and 100 which are spaced apart commensurate with the side pieces of the clip. The side members are connected at one end by an end cross-member 97 and at the other end by the side edge of the semi-cylindrical member 101. A middle cross-member 102 which bridges medial portions of the two side-members is positioned between the end cross-member and the edge of the semi-cylinder thereby forming two slots 103 and 87. These slots and their adjacent angled surfaces provide means for adjustably attaching a strap or clip.

Although many clips with hooks can be designed to engage a buckle type connector adequately, it has been found that particular features greatly enhance the functional attributes of secure fastening with quick releaseability. These features include the hook having an angled rear facing surface 89 which rests flat up against an angled front facing surface 90 at the rear termination of the slot 87. Any force components which would tend to bring the clip further back get translated into forces which drive the clip down toward the buckle. Once mated, with the front portion 95 of the lower surface of the side-pieces resting up against the buckle, the clip essentially can only move in the forward direction 91 with respect to the buckle in order to disengage the clip. This movement is discouraged by the backward bias provided by the taut strap.

Another feature allows the strap to be adjusted while the clip is attached. The middle cross-piece 81 of the clip has a downward extension 92 which rests up against a platform 93 jutting out from the end of the end cross-member 97 of the buckle. This, in conjunction with the lower surfaces 94 of the clip side-pieces resting upon the upper surfaces 98 of the buckle side-members, elevates both the first 80 and third 82 cross-pieces above the buckle, creating a gap and allowing free passage of the strap 20.

This clip also provides a raised upper lip 96 formed by the upper surfaces of both side-pieces and the front fourth cross-piece 85. This protects the strap against scuffing.

FIG. 17 shows that the end of a strap 20 may be adjustably attached to the buckle without the use of a clip.

Although other means for quickly attaching straps such as VELCRO brand fasteners are available, these types of fasteners suffer from being susceptible to contamination, such as carpet fuzz and can wear out in particularly harsh environments. The clip has no such drawbacks.

In the past, knee protectors which incorporate some of these features are too specialized or expensive for the average consumer. A reduced cost is a major advantage provided by this invention.

Since the device is semi-rigid, it provides added protection to the user's knee commensurate with that of knee braces which discourage hyperextension and other lateral problems.

By being hinged with a revolution axis substantially in line with that of the user's knee, the protector naturally and automatically seats and repositions itself over the front of the knee every time the user bends his or her knee.

Although this embodiment refers strictly to a knee protector, the size and shape of the members and other features may be adjusted to provide protectors for other joints on the body such as elbows, wrists and fingers.

Also, the members are substantially semi-cylindrical in order that they may be inexpensively manufactured and may closely contact the substantially cylindrical portion of the user's appendage surrounding his or her joint. There is no reason that a lateral cross-section of the member must be semi-circular, nor a vertical cross-section be linear. Similarly, the substantially semi-hemispherical end portions need not be restricted to portions of spherical surfaces. Any number of semi-ellipsoidal or more complicated structures may be used. Even surfaces having corrugated lateral cross-sections may be used without departing from the invention so long as the two portions overlap.

While the preferred embodiments of the invention have been described, modifications can be made and other embodiments may be devised without departing from the spirit of the invention and the scope of the appended claims.

What is claimed is:

1. A protector for covering the surface of a user's joint which comprises:

first and second substantially rigid and substantially semi-cylindrical members, each having a substantially semi-hemispherical end-portion;

means for pivotably connecting said first and second members to one another at said end-portions;

said end-portion of said first member being sized and dimensioned to slidingly overlap said end-portion of said second member;

means for releaseably and adjustably attaching said protector to said joint;

a pad of resilient, compressible material;

wherein said mean for pivotably connecting comprise reusable means for releaseably attaching said pad to an inner surface of said first member;

a protective strip; and means for releaseably attaching said strip to an outer surface of said first semi-cylindrical member;

wherein said means for attaching said strip comprise:

at least one resilient projection sized and dimensioned to engage an aperture extending from said outer surface of said first semi-cylindrical member through to said inner surface of said first semi-cylindrical member.

2. The protector of claim 1, wherein said means for attaching said strip further comprise:

a frame comprised of a bordering ridge;

said ridge integral with said first semi-cylindrical member;

said frame sized and dimensioned to border said strip while said strip is connected to said first semi-cylindrical member; and said aperture being positioned within said frame.

3. A protector for covering the surface of a user's joint which comprises:

first and second substantially rigid and substantially semi-cylindrical members, each having a substantially semi-hemispherical end-portion;

means for pivotably connecting said first and second members to one another at said end-portions;

said end-portion of said first member being sized and dimensioned to slidingly overlap said end-portion of said second member;

means for releaseably and adjustably attaching said protector to said joint;

a pad of resilient, compressible material;

wherein said means for pivotably connecting comprise reusable means for releaseably attaching said pad to an inner surface of said first member;

wherein said means for releaseably and adjustably attaching said protector to said joint comprise:

a strap;

a first connection point located substantially along a first side of said protector; and means for releaseably and adjustably connecting said strap to said first connection point comprising:

a first buckle integral with said first side of said protector;

said first buckle comprising:

a pair of oblong substantially parallel side-members, an end cross-member bridging first ends of said side-members, a middle cross-member bridging first medial portions of said side-members, said first side of said protector bridging second ends of said side-members, said end cross-member, middle cross-member, first side and side-members defining a first and second slot, and each of said slots being sized and dimensioned to allow passage of an end of said strap therethrough.

4. The protector of claim 3, wherein said means for releaseably and adjustably connecting said strap to said first connection point further comprise:

a clip having a hook sized and dimensioned to penetrate said first slot; and means for releaseably and adjustably connecting said strap to said clip.

5. The protector of claim 4, wherein said hook comprises:

an angled inner surface which rests substantially flat against an angled outer surface of said middle cross-member.

6. The protector of claim 5, wherein said means for releaseably and adjustably connecting said strap to said first connection point further comprise:

said clip comprising:

a pair of oblong substantially parallel side-pieces, a first end cross-piece bridging first ends of said side-pieces, a first middle cross-piece bridging first medial portions of said side-pieces, a second middle cross-piece bridging second medial portions of said side-pieces, a second end cross-piece bridging second ends of said side-pieces, said first and second end cross-pieces, first and second middle cross-pieces and side-pieces defining a first, second and third opening, and each of said openings being sized and dimensioned to allow passage of an end of said strap therethrough.

7. The protector of claim 6, wherein said end cross-member comprises an outwardly jutting platform and said first middle cross-piece has a downward extension which rests upon said platform thereby providing a gap between said second middle cross-piece and said middle cross-member.

8. The protector of claim 3, which further comprises:

a second buckle sized and dimensioned substantially the same as said first buckle; and said second buckle positioned on an opposite side edge of said protector.

9. The protector of claim 3, which further comprises:

a first cut, adjacent to said first connection point, extending from an edge of said first side a distance into said first side, said cut sized, dimensioned and positioned to allow greater flexibility in moving said connection point laterally.

10. A protector for covering the surface of a user's joint which comprises:

first and second substantially rigid and substantially semi-cylindrical members, each having a substantially semi-hemispherical end-portion;

wherein said first and second semi-cylindrical members are pivotably connected to one another at said end portions;

said end-portion of said first member being sized and dimensioned to slidingly overlap said end-portion of said second member;

means for releaseably and adjustably attaching said protector to said joint;

a protective strip; and means for releaseably attaching said strip to an outer surface of said first semi-cylindrical member, wherein said means for attaching said strip comprise:

at least one resilient projection sized and dimensioned to engage an aperture extending from said outer surface of said first semi-cylindrical member through to said inner surface of said first semi-cylindrical member.

11. The protector of claim 10, wherein said means for attaching said strip further comprise:

a frame comprised of a bordering ridge;

said ridge integral with said first semi-cylindrical member;

said frame sized and dimensioned to border said strip while said strip is connected to said first semi-cylindrical member; and said aperture being positioned within said frame.

12. A protector for covering the surface of a user's joint which comprises:

first and second substantially rigid and substantially semi-cylindrical members, each having a substantially semi-hemispherical end-portion;

wherein said first and second semi-cylindrical members are pivotably connected to one another at said end portions;

said end-portion of said first member being sized and dimensioned to slidingly overlap said end-portion of said second member; and means for releaseably and adjustably attaching said protector to said joint comprising:

a strap;

a first buckle integral with a first side of said protector, said first buckle comprising first and second slots sized and dimensioned to allow passage of an end of said strap therethrough, said first side of said protector forming an edge of one of said slots; and a clip having a hook sized and dimensioned to penetrate said first slot, said clip comprising first and second openings sized and dimensioned to allow passage of said end of said strap therethrough.

13. The protector of claim 12, which further comprises:

a pad of resilient, compressible material; and reusable means for releaseably attaching said pad to an inner surface of said first semi-cylindrical member.

14. The protector of claim 13, which further comprises:

a first hinged pivot point located adjacent to a first side edge of said protector;

a second hinged pivot point located adjacent to a second side edge of said protector; and each of said hinged pivot points having an axis of revolution substantially intersecting a central axis of symmetry of both semi-cylindrical members.

15. The protector of claim 12, wherein said first buckle further comprises:

a pair of oblong substantially parallel side-members, an end cross-member bridging first distal portions of said side-members, a middle cross-member bridging first medial portions of said side-members, said first side of said protector bridging first proximal portions of said side-members, said end cross-member, middle cross-member, first side of said protector and side-members defining said first and second slots.

16. The protector of claim 15, wherein said hook comprises:

an angled inner surface which rests substantially flat against an angled outer surface of said middle cross-member.

17. The protector of claim 16, wherein said clip further comprises:

a pair of oblong substantially parallel side-pieces, a first end cross-piece bridging first distal portions of said side-pieces, a first middle cross-piece bridging first medial portions of said side-pieces, a second middle cross-piece bridging second medial portions of said side-pieces, a second end cross-piece bridging second distal portions of said side-pieces, said first and second end cross-pieces, first and second middle cross-pieces and side-pieces defining said first and second openings and a third opening, and said third opening being sized and dimensioned to allow passage of said end of said strap therethrough.

18. The protector of claim 17, wherein said end cross-member comprises an outwardly jutting platform and said first middle cross-piece has a downward extension which rests upon said platform thereby providing a gap between said second middle cross-piece and said middle cross-member.

19. The protector of claim 12, which further comprises:

a second buckle sized and dimensioned substantially the same as said first buckle; and said second buckle positioned on an opposite side edge of said protector.

20. The protector of claim 12, which further comprises:

a first cut, adjacent to said first connection point, extending from an edge of said first side a distance into said first side, said cut sized, dimensioned and positioned to allow greater flexibility in moving said connection point laterally.

* * * * *